US009399741B2

(12) United States Patent
Zink et al.

(10) Patent No.: US 9,399,741 B2
(45) Date of Patent: Jul. 26, 2016

(54) METHODS AND APPARATUSES FOR DESULFURIZING HYDROCARBON STREAMS

(71) Applicant: UOP LLC, Des Plaines, IL (US)

(72) Inventors: Steven F. Zink, Westmont, IL (US); Paul C. Steacy, Mount Prospect, IL (US); Peter Kokayeff, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 344 days.

(21) Appl. No.: 14/050,113

(22) Filed: Oct. 9, 2013

(65) Prior Publication Data

US 2015/0096923 A1 Apr. 9, 2015

(51) Int. Cl.

| | |
|---|---|
| ***C10G 65/06*** | (2006.01) |
| ***C10G 45/02*** | (2006.01) |
| ***C10G 45/32*** | (2006.01) |
| ***C10G 65/16*** | (2006.01) |

(52) U.S. Cl.

CPC ..... *C10G 45/02* (2013.01); *C10G 45/32* (2013.01); *C10G 65/06* (2013.01); *C10G 65/16* (2013.01); *C10G 2300/202* (2013.01); *C10G 2300/207* (2013.01)

(58) Field of Classification Search

CPC ..... C10G 45/02; C10G 65/06; C10G 45/32; C10G 65/16; C10G 2300/207; C10G 2300/202

See application file for complete search history.

(56) References Cited

U.S. PATENT DOCUMENTS

| | | | |
|---|---|---|---|
| 5,290,427 | A | 3/1994 | Fletcher et al. |
| 6,495,030 | B1 | 12/2002 | Podrebarac |
| 6,913,688 | B2 | 7/2005 | Coker et al. |

(Continued)

FOREIGN PATENT DOCUMENTS

| | | | |
|---|---|---|---|
| CN | 103059946 | A | 4/2013 |

OTHER PUBLICATIONS

Luo, et al., "Study on Hydrodesulfurization Kinetics of FCC Naphtha Narrow Fractions," Petroleum Refinery Engineering, v 40, n. 2, p. 6-9, 2010, Language: Chinese, ISSN: 1002106X, Publisher: Editorial Office of P.R.E.

(Continued)

*Primary Examiner* — Randy Boyer
*Assistant Examiner* — Juan Valencia

(57) ABSTRACT

Methods and apparatuses for desulfurizing hydrocarbon streams are provided herein. In one embodiment, a method for desulfurizing a hydrocarbon stream includes separating the hydrocarbon stream into a heavier fraction and a lighter fraction. The heavier fraction includes a relatively higher amount of lower octane mono-unsaturates and the lighter fraction includes a relatively higher amount of higher octane mono-unsaturates. The method further includes hydrodesulfurizing the heavier fraction in a first hydrodesulfurization zone and hydrodesulfurizing the lighter fraction in a second hydrodesulfurization zone. Further, the method forms a hydrodesulfurized stream from the heavier fraction and the lighter fraction.

16 Claims, 2 Drawing Sheets

(56) References Cited

U.S. PATENT DOCUMENTS

| | | | | |
|---|---|---|---|---|
| 6,946,068 | B2 | 9/2005 | Groten | |
| 7,351,327 | B2 | 4/2008 | Podrebarac et al. | |
| 7,959,793 | B2 | 6/2011 | Bakshi | |
| 2002/0005373 | A1* | 1/2002 | Gupta | C10G 45/00 208/58 |
| 2006/0086645 | A1 | 4/2006 | Rock et al. | |
| 2008/0093265 | A1 | 4/2008 | Umansky et al. | |
| 2008/0116112 | A1 | 5/2008 | Umansky et al. | |
| 2009/0145807 | A1* | 6/2009 | Choi | C10G 55/04 208/211 |
| 2013/0240405 | A1 | 9/2013 | Kumar et al. | |
| 2014/0054198 | A1* | 2/2014 | Podrebarac | C10G 65/06 208/57 |

OTHER PUBLICATIONS

Zhang, et al., "Process Design of CDHydro and CDHDS for Selective Hydrodesulfurization of FCC Naphtha," Petroleum Refinery Engineering, v 40, n. 1, p. 6-9, 2010, Language: Chinese, ISSN: 1002106X, Publisher: Editorial Office of P.R.E.

Search Report dated Feb. 26, 2015 for corresponding PCT Appl. No. PCT/US2014/059427.

* cited by examiner

METHODS AND APPARATUSES FOR DESULFURIZING HYDROCARBON STREAMS

TECHNICAL FIELD

The technical field generally relates to methods and apparatus for processing hydrocarbon streams, and more particularly relates to methods and apparatus for desulfurizing hydrocarbon streams to form product streams having low sulfur content.

BACKGROUND

The removal of sulfur from hydrocarbon feedstreams is an important separation in the oil, gas and chemical process industries. Typical hydrocarbon processing often includes at least one processing step which is sensitive to sulfur present in the feedstream. For example, in hydrocarbon conversion processes where hydrocarbon feeds are catalytically converted to hydrocarbon products, the catalyst used in the conversion process may be sensitive to sulfur. That is, the presence of sulfur in the feedstream may deactivate or inhibit in some way the catalyst in the conversion process. Generally, the presence of such a sulfur-sensitive step will necessitate the removal of all or most of the sulfur prior to its being introduced into the sulfur-sensitive step.

Further, there are many products in these industries in which sulfur must be removed to conform to a product specification. For example, transportation fuels may be limited to low levels of sulfur. In typical hydrocarbon conversion processes for forming sulfur-sensitive products, sulfur is removed by a hydrodesulfurization step. Such a hydrodesulfurization step generally involves passing a heated, vaporized feedstream to a hydrotreating reactor that catalytically converts the sulfur in the feedstream to hydrogen sulfide, passing the hydrotreating product to a condenser in which a portion of the gaseous hydrogen sulfide is condensed with the remainder of the hydrogen sulfide leaving as overhead, and passing the liquid product to a stripper wherein the condensed hydrogen sulfide in the liquid product is removed. In lieu of a stripper, a hydrogen sulfide adsorption bed may also be used to adsorb hydrogen sulfide from the liquid product.

Transportation fuels are also required to meet certain research octane numbers (RON). Retention of a sufficiently high octane number can be difficult when removing sulfur from hydrocarbon feedstocks holding substantial amounts of sulfur, as hydrodesulfurization processes cause losses in the processed hydrocarbon's octane number.

Accordingly, it is desirable to provide methods and apparatuses for desulfurizing hydrocarbon streams. Also, it is desirable to provide methods and apparatuses that perform a moderate hydrodesulfurization process on a portion of the hydrocarbon stream to retain its octane number while performing a deep hydrodesulfurization process on another portion of a hydrocarbon stream. Furthermore, other desirable features and characteristics will become apparent from the subsequent detailed description and the appended claims, taken in conjunction with the accompanying drawings and the foregoing technical field and background.

BRIEF SUMMARY

Methods and apparatuses for desulfurizing hydrocarbon streams are provided herein. In an exemplary embodiment, a method for desulfurizing a hydrocarbon stream includes separating the hydrocarbon stream into a heavier fraction and a lighter fraction. The heavier fraction includes a relatively higher amount of lower octane mono-unsaturates and the lighter fraction includes a relatively higher amount of higher octane mono-unsaturates. The method further includes hydrodesulfurizing the heavier fraction in a first hydrodesulfurization zone and hydrodesulfurizing the lighter fraction in a second hydrodesulfurization zone. Further, the method forms a hydrodesulfurized stream from the heavier fraction and the lighter fraction.

In accordance with another exemplary embodiment, a method for desulfurizing a hydrocarbon stream includes feeding the hydrocarbon stream to a divided wall splitter and separating the stream into a $C9^+$ fraction, a C6-C8 fraction, and a C5 fraction. The method passes the $C9^+$ fraction through a deep hydrodesulfurization zone and hydrodesulfurizes the $C9^+$ fraction. Further, the method passes the C6-C8 fraction through a moderate hydrodesulfurization zone and hydrodesulfurizes the C6-C8 fraction. The method includes forming a hydrodesulfurized stream including the $C9^+$ fraction and the C6-C8 fraction.

In accordance with another exemplary embodiment, an apparatus is provided for desulfurizing a hydrocarbon stream. The apparatus includes a separation unit configured to receive the hydrocarbon stream and to separate the hydrocarbon stream into a heavier fraction and a lighter fraction. A deep hydrodesulfurization unit is provided and configured to receive the heavier fraction and to hydrodesulfurize the heavier fraction. Also, a moderate hydrodesulfurization unit is provided and configured to receive the lighter fraction and to hydrodesulfurize the lighter fraction. The apparatus further includes a downstream unit configured to receive and process a combined stream of the heavier fraction and the lighter fraction.

BRIEF DESCRIPTION OF THE DRAWING

The methods and apparatuses for desulfurizing hydrocarbon streams will hereinafter be described in conjunction with the following drawing figures, wherein like numerals denote like elements, and wherein.

DETAILED DESCRIPTION

The following Detailed Description is merely exemplary in nature and is not intended to limit the methods and apparatuses for desulfurizing hydrocarbon streams. Furthermore, there is no intention to be bound by any theory presented in the preceding background or the following detailed description.

The various embodiments contemplated herein provide for separate hydrodesulfurization of fractions of a hydrocarbon feed. Specifically, methods and apparatuses provided herein fractionate a hydrocarbon feed into a substantially mercaptan-free lightest fraction, and two fractions having higher sulfur content that require desulfurization for gasoline blending: a lighter fraction and a heavier fraction.

Of the fractions requiring desulfurization, the lighter fraction includes a relatively higher amount of higher octane mono-unsaturates than the heavier fraction, while the heavier fraction includes a relatively higher amount of lower octane mono-unsaturates than the lighter fraction. In order to retain its higher octane, the lighter fraction is moderately hydrodesulfurized with a relatively high selectivity catalyst (a catalyst that saturates fewer mono-unsaturates). On the other hand, the heavier fraction can be deeply hydrodesulfurized with a relatively low selectivity catalyst (a catalyst that saturates more mono-unsaturates) without significant octane loss. As a result of the separate hydrodesulfurization of the fractions of the hydrocarbon feed, the apparatus and method described herein provide for forming a high octane, low sulfur product stream.

Figure 1:
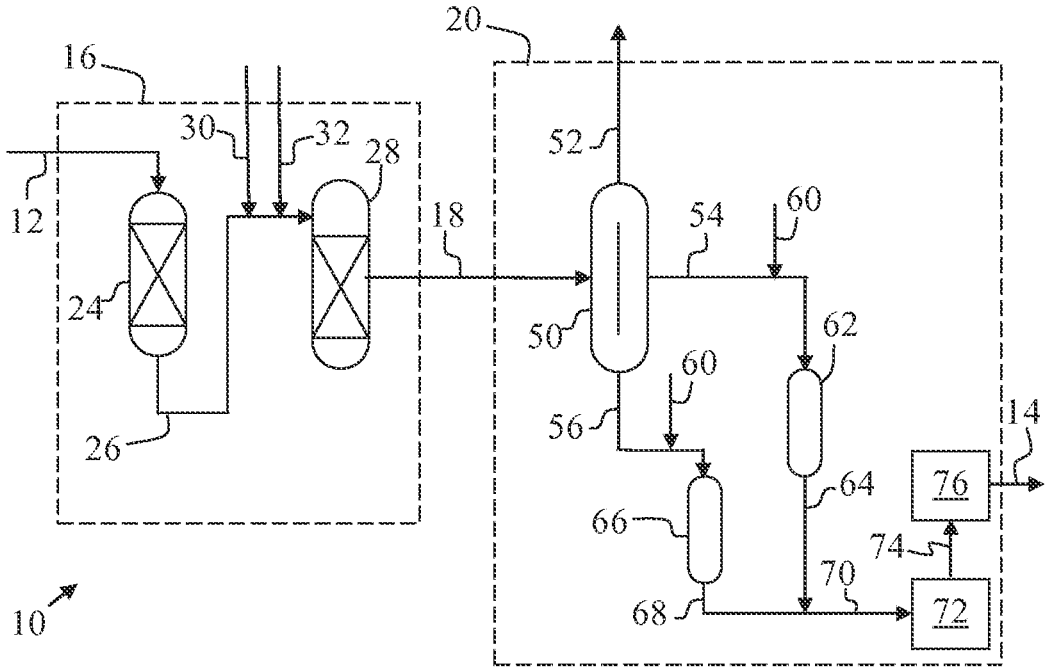
FIG. 1 is a schematic view of a method and apparatus for desulfurizing a hydrocarbon stream in accordance with an exemplary embodiment.

In FIG. 1, an apparatus 10 is provided for processing a hydrocarbon feed stream 12 to form a desulfurized stream 14. An exemplary hydrocarbon feed stream 12 is a naphtha feedstock. Naphtha feedstocks include aromatics, paraffins, naphthenes, and olefins. Feedstocks which may be utilized include straight-run naphthas, natural gasoline, synthetic naphthas, thermal gasoline, and reformed naphthas. In an exemplary embodiment, the hydrocarbon feed stream is a fluid catalytic cracking (FCC) naphtha.

As shown, the apparatus 10 includes a pretreatment section 16 for preparing a sweetened, substantially diolefin-free stream 18 from the hydrocarbon feed stream 12. Further, the apparatus includes a desulfurization section 20 for removing sulfur from the sweetened, substantially diolefin-free stream 18 to form the desulfurized stream 14.

The exemplary pretreatment section 16 includes a diolefin saturation unit 24. Diolefins easily polymerize under hydrodesulfurization conditions. Therefore, they must be removed from the hydrocarbon stream before it undergoes hydrodesulfurization in the desulfurization section 20. An exemplary diolefin saturation unit 24 catalytically saturates diolefins in the hydrocarbon feed stream 12. Catalysts may be held in the diolefin saturation unit 24 in a packed bed. Exemplary catalysts for the diolefin saturation reaction include nickel molybdenum, cobalt molybdenum, or other suitable catalysts. In an exemplary embodiment, the diolefin saturation unit 24 is operated at a temperature of less than 205° C., as reactions in the diolefin saturation unit 24 may be limited to saturation reactions at that temperature. Typically, the diolefin saturation unit 24 is able to saturate substantially all of the diolefin in the hydrocarbon feed stream 12 to form a substantially diolefin-free stream 26. For example, the diolefin saturation unit 24 may saturate a hydrocarbon feed stream 12 containing about 5 weight percent (wt %) to form a substantially diolefin-free stream 26 containing less than 50 weight parts per million (wt ppm) of diolefins, for example less than 10 wt ppm of diolefins.

In the exemplary embodiment, the substantially diolefin-free stream 26 exits the diolefin saturation unit 24 and is fed to a sweetening unit 28 for removing mercaptans and carbon dioxide from the substantially diolefin-free stream 26. Dilute caustic 30 is continuously added to the sweetening unit 28 to maintain alkalinity during sweetening. Further, air 32 is added to the substantially diolefin-free stream 26 before it enters the sweetening unit 28 to support oxidation reactions. An exemplary sweetening unit 28 includes a fixed bed of activated charcoal impregnated oxidation catalyst. When the substantially diolefin-free stream 26 is passed through the fixed bed of catalyst, mercaptans are oxidized over the catalyst to disulfides. The disulfides, being oil soluble, remain in the hydrocarbon phase. The sweetened, substantially diolefin-free stream 18 exits the pretreatment section 16 and is introduced to the desulfurization section 20.

In the desulfurization section 20, the sweetened, substantially diolefin-free stream 18 enters a fractionation unit 50. An exemplary fractionation unit 50 is a divided wall splitter. The fractionation unit 50 is operated at conditions suitable for forming an overhead fraction 52 primarily containing hydrocarbons having five carbon atoms (CS) that exits the fractionation unit 50 at or around its top. An exemplary overhead fraction 52 contains more than about 90%, for example more than about 95%, hydrocarbons having five carbon atoms.

The fractionation unit 50 further forms a sidedraw fraction 54 primarily containing hydrocarbons having from six to eight carbon atoms (C6-C8) that exits the fractionation unit 50 at a sidedraw location. An exemplary sidedraw fraction 54 is rich in C6-C8 and contains more than about 90%, for example more than about 95%, hydrocarbons having six to eight carbon atoms. The fractionation unit 50 also forms a bottom fraction 56 primarily containing hydrocarbons having nine and more carbon atoms ($C9^+$) that exits from the fractionation unit 50 at or around its bottom. An exemplary bottom fraction 56 contains more than about 90%, for example more than about 95%, hydrocarbons having nine and more carbon atoms. As used herein, the phrase "overhead fraction" is not limited to the uppermost fraction from a fractionation process, but may include the uppermost fraction and/or any fraction formed above the sidedraw and bottom fraction. Further, as used herein, the phrase "bottom fraction" is not limited to the lowermost fraction from a fractionation process, but may include the lowermost fraction and/or any fraction formed below the sidedraw and overhead fraction.

The different fractions (such as C5, C6-C8, and $C9^+$) are separated based on the relative boiling points of the compounds present. To provide desired separation, the fractionation unit 50 can be operated from a pressure of about 10 kiloPascals absolute (kPa) to about 400 kPa. In an exemplary embodiment, the fractionation operating conditions provide for maximizing the recovery of sweet high-octane mono-unsaturates-rich C5 in the overhead fraction 52 while limiting sulfur content to below 50 wt ppm, for example below 10 wt ppm.

The overhead fraction 52, sidedraw fraction 54 and bottom fraction 56 include different amounts of sulfur species. Specifically, the overhead fraction 52 is relatively sweet, containing less than 50 wt ppm of sulfur, for example less than 10 wt ppm of sulfur, and is suitable for direct processing in gasoline blending. Of the other fractions, the lighter fraction, sidedraw fraction 54, includes a more moderate amount of sulfur species. For example, the sidedraw fraction 54 includes about 300 wt ppm to about 500 wt ppm sulfur. The heavier fraction, bottom fraction 56, includes a relative high amount of sulfur species. For example, the bottom fraction 56 includes about 1500 wt ppm to about 2000 wt ppm sulfur. Further, the sidedraw fraction 54 includes a relatively higher amount of higher octane mono-unsaturates while the bottom fraction 56 includes a relatively lower amount of mono-unsaturates, and the mono-unsaturates in the bottom fraction 56 have the lowest octane rating of all the mono-unsaturates in the feed 18.

As the overhead fraction 52 has a sufficiently low sulfur content, it may exit the desulfurization section 20 of the apparatus 10 and be delivered to a gasoline blending section. The sidedraw fraction 54 and bottom fraction 56; however, require desulfurization before introduction to gasoline blending. For desulfurization, hydrogen 60 is fed to each fraction 54 and 56 and each fraction 54 and 56 is heated to a desired hydrodesulfurization temperature. The sidedraw fraction 54 is fed to a moderate hydrodesulfurization zone 62 that holds a relatively high selectivity catalyst (a catalyst that saturates fewer mono-unsaturates) and operates in the temperature range of about 250° C. to about 340° C. An exemplary catalyst is formed from nickel, molybdenum, cobalt, iron, or other suitable materials. In the moderate hydrodesulfurization zone 62, sulfur species in the vaporized sidedraw fraction 54 are catalytically converted to hydrogen sulfide. As the sidedraw fraction 54 includes a relatively higher portion of mono-saturates with a relatively higher octane value, the use of a relatively high selectivity catalyst in the moderate hydrodesulfurization zone 62 prevents octane loss. A C6-C8 hydrodesulfurization effluent 64 is formed and exits the moderate hydrodesulfurization zone 62 with a (non hydrogen sulfide) sulfur content of less than about 10 wt ppm and little octane loss.

The bottom fraction 56 is fed to a deep hydrodesulfurization zone 66 that holds a relatively low selectivity catalyst (a catalyst that saturates more mono-unsaturates) and operates in the temperature range of about 250° C. to about 340° C. An exemplary catalyst is formed from nickel, molybdenum, cobalt, iron, or other suitable materials. In the hydrodesulfurization zone 66, sulfur species in the vaporized bottom fraction 56 are catalytically converted to hydrogen sulfide. Because the bottom fraction 56 includes a relatively smaller portion of mono-saturates, the relatively low selectivity catalyst can be used in the moderate hydrodesulfurization zone 62 and provide for deep hydrodesulfurization without causing significant octane loss. As a result, a $C9^+$ hydrodesulfurization effluent 68 is formed and exits the hydrodesulfurization zone 66 with a (non hydrogen sulfide) sulfur content of less than about 1 wt ppm and little octane loss.

As shown, the C6-C8 hydrodesulfurization effluent 64 and the $C9^+$ hydrodesulfurization effluent 68 are combined to form a combined stream 70 that is condensed. A portion of the gaseous hydrogen sulfide is condensed while the remainder of the hydrogen sulfide remains in the gaseous phase. The condensed combined stream 70 is fed to a de-gassing unit 72. In de-gassing unit 72, gases are removed from the combined stream 70 to form a de-gassed stream 74. De-gassed stream 74 is fed to a hydrogen sulfide stripping unit 76. In the hydrogen sulfide stripping unit 76, the condensed hydrogen sulfide is removed from the de-gassed stream 74. As a result, the desulfurized stream 14 is formed with a sulfur content of less than 50 wt ppm, for example less than 10 wt ppm, while substantially retaining its octane number.

Figure 2:
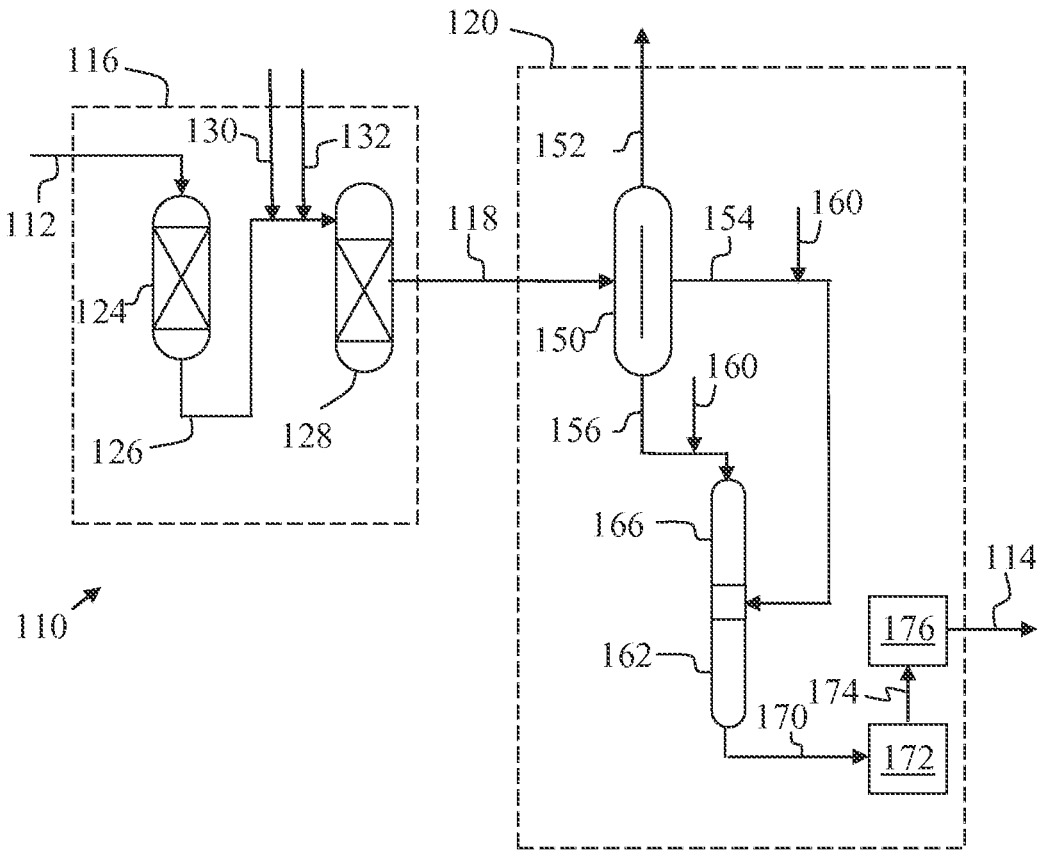
FIG. 2 is a schematic view of a method and apparatus for desulfurizing a hydrocarbon stream in accordance with an alternate embodiment.

Referring to FIG. 2, an alternate apparatus 110 is provided for processing a hydrocarbon feed stream 112 to form a desulfurized stream 114. An exemplary hydrocarbon feed stream 112 is a naphtha feedstock, for example a fluid catalytic cracking (FCC) naphtha.

As shown, the apparatus 110 includes a pretreatment section 116 for preparing a sweetened, substantially diolefin-free stream 118 from the hydrocarbon feed stream 112. Further, the apparatus includes a desulfurization section 120 for removing sulfur from the sweetened, substantially diolefin-free stream 118 to form the desulfurized stream 114.

The exemplary pretreatment section 116 includes a diolefin saturation unit 124. Diolefins easily polymerize under hydrodesulfurization conditions. Therefore, they must be removed from the naphtha before it undergoes hydrodesulfurization in the desulfurization section 120. An exemplary diolefin saturation unit 124 catalytically saturates diolefins in the hydrocarbon feed stream 112. Catalysts may be held in the diolefin saturation unit 124 in a packed bed. Exemplary catalysts for the diolefin saturation reaction include nickel molybdenum, cobalt molybdenum, or other suitable catalysts. In an exemplary embodiment, the diolefin saturation unit 124 is operated at a temperature of less than 205° C., as reactions in the diolefin saturation zone 124 may be limited to saturation reactions at that temperature. Typically, the diolefin saturation unit 124 is able to saturate substantially all of the diolefin in the hydrocarbon feed stream 112 to form a substantially diolefin-free stream 126. For example, the diolefin saturation unit 124 may saturate a hydrocarbon feed stream 112 containing about 5 weight percent (wt %) to form a substantially diolefin-free stream 126 containing less than 50 weight parts per million (wt ppm) of diolefins, for example less than 10 wt ppm of diolefins.

In the exemplary embodiment, the substantially diolefin-free stream 126 exits the diolefin saturation unit 124 and is fed to a sweetening unit 128 for removing mercaptans and carbon dioxide from the substantially diolefin-free stream 126. Dilute caustic 130 is continuously added to the sweetening unit 128 to maintain alkalinity during sweetening. Further, air 132 is added to the substantially diolefin-free stream 126 before it enters the sweetening unit 128 to support oxidation reactions. An exemplary sweetening unit 128 includes a fixed bed of activated charcoal impregnated oxidation catalyst. When the substantially diolefin-free stream 126 is passed through the fixed bed of catalyst, mercaptans are oxidized over the catalyst to disulfides. The disulfides, being oil soluble, remain in the hydrocarbon phase. The sweetened, substantially diolefin-free stream 118 exits the pretreatment section 116 and is introduced to the desulfurization section 120.

In the desulfurization section 120, the sweetened, substantially diolefin-free stream 118 enters a fractionation unit 150. An exemplary fractionation unit 150 is a divided wall splitter. The fractionation unit 150 is operated at conditions suitable for forming an overhead fraction 152 primarily containing hydrocarbons having five carbon atoms (C5) that exits the fractionation unit 150 at or around its top. An exemplary overhead fraction 152 contains more than about 90%, for example more than about 95%, hydrocarbons having five carbon atoms.

The fractionation unit 150 further forms a sidedraw fraction 154 primarily containing hydrocarbons having from six to eight carbon atoms (C6-C8) that exits the fractionation unit 150 at a sidedraw location. An exemplary sidedraw fraction 154 is rich in C6-C8 and contains more than about 90%, for example more than about 95%, hydrocarbons having six to eight carbon atoms. The fractionation unit 150 also forms a bottom fraction 156 primarily containing hydrocarbons having nine and more carbon atoms ($C9^+$) that exits from the fractionation unit 150 at or around its bottom. An exemplary bottom fraction 156 contains more than about 90%, for example more than about 95%, hydrocarbons having nine and more carbon atoms.

The different fractions (such as C5, C6-C8, and $C9^+$) are separated based on the relative boiling points of the compounds present. To provide desired separation, the fractionation unit 114 can be from a pressure of about 10 kPa to about 400 kPa. In an exemplary embodiment, the fractionation operating conditions provide for maximizing the recovery of sweet high-octane mono-unsaturates-rich C5 in the overhead fraction 52 while limiting sulfur content to below 50 wt ppm, for example below 10 wt ppm.

The overhead fraction 152, sidedraw fraction 154 and bottom fraction 156 include different amounts of sulfur species. Specifically, the overhead fraction 152 is relatively sweet, containing less than 50 wt ppm of sulfur, for example less than 10 wt ppm of sulfur, and is suitable for direct processing in gasoline blending. Of the other fractions, the lighter fraction, sidedraw fraction 154, includes a more moderate amount of sulfur species. For example, the sidedraw fraction 154 includes about 300 wt ppm to about 500 wt ppm sulfur. The heavier fraction, bottom fraction 156, includes a relative high amount of sulfur species. For example, the bottom fraction 156 includes about 1500 wt ppm to about 2000 wt ppm sulfur. Further, the sidedraw fraction 154 includes a relatively higher amount of higher octane mono-unsaturates while the bottom fraction 156 includes a relatively higher amount of lower octane mono-unsaturates.

As the overhead fraction 152 has a sufficiently low sulfur content, it may exit the desulfurization section 120 of the apparatus 110 and be delivered to a gasoline blending section. The sidedraw fraction 154 and bottom fraction 156; however, require desulfurization before introduction to gasoline blending. For desulfurization, hydrogen 160 is fed to each fraction 154 and 156 and each fraction 154 and 156 is heated before further processing. The sidedraw fraction 154 is fed to a moderate hydrodesulfurization zone 162 that holds a relatively high selectivity catalyst (a catalyst that saturates fewer mono-unsaturates) and operates in the temperature range of about 250° C. to about 340° C. An exemplary catalyst is formed from nickel, molybdenum, cobalt, iron, or other suitable materials. In the hydrodesulfurization zone 162, sulfur species in the vaporized sidedraw fraction 154 are catalytically converted to hydrogen sulfide. As the sidedraw fraction 154 includes a relatively higher portion of mono-saturates with a relatively higher octane value, the use of a relatively high selectivity catalyst in the hydrodesulfurization zone 162 prevents octane loss. A C6-C8 hydrodesulfurization effluent is formed and exits the hydrodesulfurization zone 162 with a (non hydrogen sulfide) sulfur content of less than about 10 wt ppm and little octane loss.

The bottom fraction 156 is fed to a deep hydrodesulfurization zone 166 that holds a relatively low selectivity catalyst (a catalyst that saturates more mono-unsaturates) and operates in the temperature range of about 250° C. to about 340° C. An exemplary catalyst is formed from nickel, molybdenum, cobalt, iron, or other suitable materials. In the hydrodesulfurization zone 166, sulfur species in the vaporized bottom fraction 156 are catalytically converted to hydrogen sulfide. Because the bottom fraction 156 includes a relatively smaller portion of mono-saturates, the relatively low selectivity catalyst can be used in the hydrodesulfurization zone 162 and provide for deep hydrodesulfurization without causing significant octane loss. As a result, a $C9^+$ hydrodesulfurization effluent is formed and exits the hydrodesulfurization zone 166 with a (non hydrogen sulfide) sulfur content of less than about 1 wt ppm and little octane loss.

As shown, hydrodesulfurization zone 166 and 162 are positioned in a single reactor, with the hydrodesulfurization zone 166 arranged as a higher stage above the hydrodesulfurization zone 162. As a result, the $C9^+$ hydrodesulfurization effluent flows from the hydrodesulfurization zone 166 into the hydrodesulfurization zone 162 and is combined with the sidedraw fraction 154. The sidedraw fraction 154 cools the $C9^+$ hydrodesulfurization effluent before entering the catalyst bed within the hydrodesulfurization zone 162.

The $C9^+$ hydrodesulfurization effluent and sidedraw fraction 154 pass through the moderate hydrodesulfurization zone 162 and exit as a combined stream 170. The combined stream 170 is condensed such that a portion of the gaseous hydrogen sulfide is condensed while the remainder of the hydrogen sulfide remains in the gaseous phase. The condensed combined stream 170 is fed to a de-gassing unit 172. In de-gassing unit 172, gases are removed from the combined stream 170 to form a de-gassed stream 174. De-gassed stream 174 is fed to a hydrogen sulfide stripping unit 176. In the hydrogen sulfide stripping unit 176, the condensed hydrogen sulfide is removed from the de-gassed stream 174. As a result, the product stream 114 is formed with a sulfur content of less than 50 wt ppm, for example less than 10 wt ppm, while retaining its higher octane components.

In FIG. 2, it can be seen that the relatively higher amount of higher octane mono-unsaturates in the sidedraw fraction 154 avoid the deep hydrodesulfurization conditions of the hydrodesulfurization zone 166. The bottom fraction 156 passes through both the deep hydrodesulfurization zone 166 and the moderate hydrodesulfurization zone 162. In an exemplary embodiment, benefits of passing the bottom fraction 156 through both zones 162 and 166 include that (1) the organic sulfur entering the moderate hydrodesulfurization zone 162 will be less in concentration (by dilution), and (2) the reactor design can be limited to one vessel containing both reaction zones, reducing capital expense and plot space requirements. In an exemplary embodiment, reducing the organic sulfur in the feed to the moderate hydrodesulfurization stage is beneficial, because can allow for this stage to operate at a lower temperature and therefore with reduced saturation of mono-unsaturates and therefore greater octane retention than if the feed's organic sulfur content were not reduced by dilution.

As described, methods and apparatuses for desulfurizing hydrocarbon streams provide for efficient removal of sulfur while retaining high octane content. The hydrocarbon stream is fractionated into a lighter fraction and a heavier fraction. The lighter fraction includes a relatively higher amount of higher octane mono-unsaturates than the heavier fraction, while the heavier fraction includes a relatively higher amount of lower octane mono-unsaturates than the lighter fraction. The lighter fraction is moderately hydrodesulfurized with a relatively high selectivity catalyst (a catalyst that saturates fewer mono-unsaturates) in order to retain its higher octane. The heavier fraction can be deeply hydrodesulfurized with a relatively low selectivity catalyst (a catalyst that saturates more mono-unsaturates) without significant octane loss. As a result of the separate hydrodesulfurization of the fractions of the hydrocarbon feed, the apparatus and method described herein provide for forming a high octane, low sulfur product stream.

Accordingly, methods and apparatuses for desulfurizing a hydrocarbon stream have been described. While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the processes without departing from the scope defined by the claims, which includes known equivalents and foreseeable equivalents at the time of filing this patent application.

What is claimed is:

1. A method for desulfurizing a hydrocarbon stream, the method comprising the steps of:

separating the hydrocarbon stream into a heavier fraction and a lighter fraction, wherein the heavier fraction includes a relatively higher amount of lower octane mono-unsaturates and the lighter fraction includes a relatively higher amount of higher octane mono-unsaturates;

hydrodesulfurizing the heavier fraction in a first hydrodesulfurization zone;

hydrodesulfurizing the lighter fraction in a second hydrodesulfurization zone;

forming a hydrodesulfurized stream from the heavier fraction and the lighter fraction;

de-gassing the hydrodesulfurized stream;

stripping hydrogen sulfide from the hydrodesulfurized stream;

providing a naphtha stream; and catalytically sweetening the naphtha stream and saturating diolefins in the naphtha stream to form the hydrocarbon stream.

2. The method of claim 1 wherein separating the hydrocarbon stream into a heavier fraction and a lighter fraction comprises separating the hydrocarbon stream into the heavier fraction, the lighter fraction, and a lightest fraction.

3. The method of claim 1 further comprising:

heating the heavier fraction before hydrodesulfurizing the heavier fraction in the first hydrodesulfurization zone; and heating the lighter fraction before hydrodesulfurizing the lighter fraction in the second hydrodesulfurization zone.

4. The method of claim 1 wherein separating the hydrocarbon stream into a heavier fraction and a lighter fraction comprises separating the hydrocarbon stream into a C9+ fraction and a C6-C8 fraction.

5. The method of claim 1 wherein:

hydrodesulfurizing the heavier fraction in the first hydrodesulfurization zone comprises hydrodesulfurizing the heavier fraction with a lower selectivity catalyst; and hydrodesulfurizing the lighter fraction in the second hydrodesulfurization zone comprises hydrodesulfurizing the lighter fraction with a higher selectivity catalyst.

6. The method of claim 1 wherein hydrodesulfurizing the heavier fraction in the first hydrodesulfurization zone comprises forming a hydrodesulfurized heavier fraction having a sulfur content of less than about 1 wt ppm.

7. The method of claim 6 wherein hydrodesulfurizing the lighter fraction in the second hydrodesulfurization zone and forming a hydrodesulfurized stream from the heavier fraction and the lighter fraction comprises forming the hydrodesulfurized stream having a sulfur content of less than about 50 wt ppm.

8. The method of claim 6 wherein hydrodesulfurizing the lighter fraction in the second hydrodesulfurization zone and forming a hydrodesulfurized stream from the heavier fraction and the lighter fraction comprises forming the hydrodesulfurized stream having a sulfur content of less than about 10 wt ppm.

9. The method of claim 1 wherein:

hydrodesulfurizing the heavier fraction in a first hydrodesulfurization zone comprises forming a hydrodesulfurized heavier fraction; and hydrodesulfurizing the lighter fraction in a second hydrodesulfurization zone comprises passing the lighter fraction and the hydrodesulfurized heavier fraction through the second hydrodesulfurization zone.

10. The method of claim 1 wherein:

hydrodesulfurizing the heavier fraction in the first hydrodesulfurization zone comprises hydrodesulfurizing the heavier fraction in an upstream stage of a reactor and forming a hydrodesulfurized heavier fraction; and hydrodesulfurizing the lighter fraction in the second hydrodesulfurization zone comprises hydrodesulfurizing the lighter fraction and the hydrodesulfurized heavier fraction in a downstream stage of the reactor.

11. The method of claim 1 wherein:

hydrodesulfurizing the heavier fraction in the first hydrodesulfurization zone comprises hydrodesulfurizing the heavier fraction in a first hydrodesulfurization reactor; and hydrodesulfurizing the lighter fraction in the second hydrodesulfurization zone comprises hydrodesulfurizing the lighter fraction in a second hydrodesulfurization reactor.

12. A method for desulfurizing a hydrocarbon stream, the method comprising the steps of:

feeding the hydrocarbon stream to a divided wall splitter and separating the hydrocarbon stream into a C9+ fraction, a C6-C8 fraction, and a C5 fraction;

passing the C9+ fraction through a deep hydrodesulfurization zone and hydrodesulfurizing the C9+ fraction;

passing the C6-C8 fraction through a moderate hydrodesulfurization zone and hydrodesulfurizing the C6-C8 fraction; and forming a hydrodesulfurized stream including the C9+ fraction and the C6-C8 fraction.

13. The method of claim 12 wherein forming a hydrodesulfurized stream including the C9+ fraction and the C6-C8 fraction comprises combining the C9+ fraction with the C6-C8 fraction after hydrodesulfurizing the C9+ fraction and after hydrodesulfurizing the C6-C8 fraction.

14. The method of claim 12 wherein forming a hydrodesulfurized stream including the C9+ fraction and the C6-C8 fraction comprises combining the C9+ fraction with the C6-C8 fraction after hydrodesulfurizing the C9+ fraction and before hydrodesulfurizing the C6-C8 fraction.

15. The method of claim 12 further comprising, after separating the hydrocarbon stream into a C9+ fraction and a C6-C8 fraction, heating the C9+ fraction before passing the C9+ fraction through the deep hydrodesulfurization zone and heating the C6-C8 fraction before passing the C6-C8 fraction through the moderate hydrodesulfurization zone.

16. The method of claim 12 further comprising:

de-gassing the hydrodesulfurized stream; and stripping hydrogen sulfide from the hydrodesulfurized stream.

* * * * *